US006180318B1

(12) United States Patent
Fitzer et al.

(10) Patent No.: US 6,180,318 B1
(45) Date of Patent: Jan. 30, 2001

(54) METHOD OF IMAGING AN ARTICLE

(75) Inventors: Robert C. Fitzer, North Oaks; Haitao Huang, Woodbury; Pierre H. LePere, Cottage Grove; Theresa A. McCarthy-Pohl, Inver Grove Heights; Robert D. Waid, Oakdale, all of MN (US)

(73) Assignee: 3M Innovative Properties Company, St. Paul, MN (US)

( * ) Notice: Under 35 U.S.C. 154(b), the term of this patent shall be extended for 0 days.

(21) Appl. No.: 09/314,554

(22) Filed: May 19, 1999

(51) Int. Cl.[7] ..... G03C 5/56

(52) U.S. Cl. ..... 430/292; 430/17; 430/293; 430/346; 430/945

(58) Field of Search ..... 430/292, 293, 430/346, 363, 365, 945, 9, 17

(56) References Cited

U.S. PATENT DOCUMENTS

| | | | |
|---|---|---|---|
| Re. 24,906 | 12/1960 | Ulrich | 206/59 |
| 2,532,011 | 11/1950 | Dahlquist et al. | 154/53.5 |
| 2,607,711 | 8/1952 | Hendricks | 117/122 |
| 3,318,852 | 5/1967 | Dixon | 260/78.5 |
| 3,474,457 | 10/1969 | Becker | 346/76 |
| 3,502,497 | 3/1970 | Crocker | 117/68.5 |
| 3,560,894 | 2/1971 | Fettweis | 333/72 |
| 3,720,784 | 3/1973 | Maydan et al. | 178/6.6 |
| 3,902,660 | 9/1975 | Barber | 233/26 |
| 3,924,093 | 12/1975 | Feldman et al. | 219/121 |
| 4,032,691 | 6/1977 | Kido et al. | 428/304 |
| 4,188,214 | 2/1980 | Kido et al. | 430/494 |
| 4,241,190 | 12/1980 | Lichter et al. | 521/54 |
| 4,430,366 | 2/1984 | Crawford | 427/162 |
| 4,657,840 * | 4/1987 | Fisch | 430/201 |
| 4,711,815 * | 12/1987 | Yoshiike et al. | 428/411.1 |
| 4,728,571 | 3/1988 | Clemens et al. | 428/352 |

(List continued on next page.)

FOREIGN PATENT DOCUMENTS

| | | |
|---|---|---|
| 2155233 | 2/1997 | (CA) . |
| 195 09 505 | 1/1996 | (DE) . |
| 196 42 040 | 1/1998 | (DE) . |
| 0 645 747 | 9/1994 | (EP) . |
| 0 673 785 | 9/1995 | (EP) . |
| 0 732 221 | 9/1996 | (EP) . |
| 0 782 933 | 7/1997 | (EP) . |
| 58-7394 | 7/1981 | (JP) . |
| WO95/34263 | 12/1995 | (WO) . |
| WO98/16397 | 4/1998 | (WO) . |
| WO98/45827 | 10/1998 | (WO) . |
| WO99/16625 | 4/1999 | (WO) . |

OTHER PUBLICATIONS

"Handbook of Adhesives", 3rd Ed., I Skeist (Ed.), pp. 5–9 and 21–38, Van Nostrand Reinhold, New York, NY 1990.

*Primary Examiner*—John A. McPherson
(74) *Attorney, Agent, or Firm*—James J. Trussell

(57) ABSTRACT

A method of imaging an article comprising a metal/metal oxide imageable layer with a laser beam. In particular, the present invention relates to a method for imparting a color image on the article. The method includes: a) providing an article including a substrate and an imageable layer, the imageable layer comprising a metal/metal oxide layer; b) imagewise applying a laser beam to the article; and c) in the portion of the article having the laser applied thereto, imparting a color to the metal/metal oxide layer different from the color in the non-imaged portion. Preferably, the imageable layer comprises aluminum/aluminum oxide. Also presented are imageable articles, and the resulting imaged articles.

30 Claims, 2 Drawing Sheets

U.S. PATENT DOCUMENTS

| | | | |
|---|---|---|---|
| 5,032,460 | 7/1991 | Kantner et al. | 428/449 |
| 5,202,190 | 4/1993 | Kantner et al. | 428/447 |
| 5,214,119 | 5/1993 | Leir et al. | 528/28 |
| 5,290,615 | 3/1994 | Tushaus et al. | 428/40 |
| 5,302,493 | 4/1994 | Strandjord et al. | 430/321 |
| 5,340,628 | 8/1994 | McKillip | 428/40 |
| 5,357,706 | 10/1994 | Berg | 43/4 |
| 5,491,003 * | 2/1996 | Akahira | 427/255.3 |
| 5,626,966 | 5/1997 | Külper et al. | 428/423.1 |
| 5,750,630 | 5/1998 | Sengupta | 528/59 |
| 5,766,827 | 6/1998 | Bills et al. | 430/346 |
| 5,783,360 | 7/1998 | Phillips et al. | 430/270.12 |
| 5,837,424 * | 11/1998 | Chaiken et al. | 430/270.12 |
| 6,066,437 | 5/2000 | Kösslinger | 430/297 |

* cited by examiner

METHOD OF IMAGING AN ARTICLE

TECHNICAL FIELD

The present invention generally relates to a method of imaging an article comprising a metal/metal oxide imageable layer with a laser beam, and more particularly to such a method for imparting a color image on the article.

BACKGROUND OF THE INVENTION

Many techniques are commercially available for imparting images or information onto labels, tapes, and like articles. This includes various printing techniques such as flexography, lithography, and electrophotography. It is also known to use a laser to impart images or information onto materials which can be imaged by laser. For example, U.S. Pat. No. 5,766,827 discloses a process for forming an image on a substrate comprising the steps of providing an imageable element comprising a film having a coating of a black metal on one surface thereof, directing radiation in an imagewise distributed pattern at said black metal layer with sufficient intensity to substantially increase the light transmissivity of the medium in the irradiated region in an imagewise distributed pattern, said element having no layers comprising a thermally activated gas-generating composition. The image comprises residual black metal on the film base, and may be used for overhead transparencies, contact negatives/positives, and the like. A preferred embodiment of the black metal layer comprises a black aluminum layer comprising from at least 19 atomic percent of oxygen to less than 58 atomic percent oxygen.

SUMMARY OF THE INVENTION

It is desirable to further improve the performance of laser-imageable metal/metal oxide articles, such as by providing the ability to impart one or more colors to the imageable layers, by providing the ability to quickly and efficiently impart the image with a low power laser, and by avoiding significant ablation of the imageable layer to reduce contamination concerns. It is also desirable to provide durable imaged articles.

One aspect of the present invention provides a method for imaging an article. The method comprises the steps of: a) providing an article including a substrate and an imageable layer, the imageable layer comprising a metal/metal oxide layer; b) imagewise applying a laser beam to the article; and c) in the portion of the article having the laser applied thereto, imparting a color to the metal/metal oxide layer different from the color in the non-imaged portion.

In one preferred embodiment of the above method, step b) further includes changing the distribution of metal oxidation states within the metal/metal oxide layer. In one aspect, this can occur by any one or combination of oxidation, reduction, and disproportionation.

In another preferred embodiment of the above method, step b) includes changing the size distribution of at least one of the phases of the metal/metal oxide layer.

In another preferred embodiment of the above method, the imageable layer comprises an aluminum/aluminum oxide layer. In one aspect of this embodiment, step b) further includes changing the distribution of aluminum oxidation states within the aluminum/aluminum oxide layer. In one aspect, this can occur by any one or combination of oxidation and reduction. In another aspect of this embodiment, step b) includes changing the size distribution of at least one of the phases of the aluminum/aluminum oxide layer.

In another preferred embodiment of the above method, the percent of oxygen atoms in the metal/metal oxide layer comprises a gradient, and wherein the percent of oxygen atoms varies from one surface to the opposite surface by at least 10 percentage points, and in another preferred embodiment, by at least 40 percentage points.

In another preferred embodiment of the above method, the imageable layer includes a reflective layer at one surface thereof.

In another preferred embodiment of the above method, step b) comprises applying no more than 3 J/cm$^2$; in another, no more than 500 mJ/cm$^2$; and in yet another, no more than 200 mJ/cm$^2$.

In another preferred embodiment of the above method, step b) comprises applying the laser beam for between 30 nanoseconds and 30 milliseconds to each respective imaged portion.

In another preferred embodiment of the above method, step c) includes imparting a visually perceptible color. In one aspect of this embodiment, step c) includes imparting at least two different visually perceptible colors.

In another preferred embodiment of the above method, step c) includes imparting a color sufficiently distinct from the non-imaged portion so as to impart a machine-readable image, such as a bar code.

In another preferred embodiment of the above method, step c) includes imparting a color having a different hue than the non-imaged portion.

In another preferred embodiment of the above method, step b) causes essentially no ablation in the imaged portion.

In another preferred embodiment of the above method, the imageable article further includes a protective layer on the metal/metal oxide layer. The protective layer may be laminated to the metal/metal oxide layer with a pressure sensitive adhesive.

In another preferred embodiment of the above method, the imageable article includes an adhesive layer for attaching the imageable article to a surface. The imageable article may include a release liner temporarily attached to the adhesive layer, and/ or a low adhesion backsize layer opposite the adhesive layer.

The present invention also provides an article imaged by any of the preferred methods described herein.

The present invention also provides the preferred imageable articles described herein, and the preferred imaged articles described herein. The articles are useful for applications such as tapes, labels, decorative articles, and the like.

Certain terms are used in the description and the claims that, while for the most part are well known, may require some explanation. In describing the application of a laser beam to a substrate for a period of time, the terms Power, Irradiance and Fluence are often used. Power (P) is an expression of the rate at which work (W) is done:

$$P=W/t \text{ where } t=\text{time}$$

and is expressed in Joules/sec or its equivalent, Watts. Alternatively, the application of power for a period of time:

$$P\cdot t=W=\Delta E$$

results in Work or its equivalent, change in energy, which is expressed in Joules. When the laser beam, having a specific Power (or rate of work) is applied to an Area (A), the ratio:

$$P/A=I$$

defines a level of Irradiance, expressed in Watts/m$^2$. Finally, the product of Irradiance and time:

$$I\cdot t=(P\cdot t)/A=W/A=F$$

gives the Fluence which is Work per unit Area (expressed as Joules/m$^2$). For applying the above to this application, it is assumed that the imaged area is the same as the area irradiated by the laser beam.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE INVENTION

Figure 1:
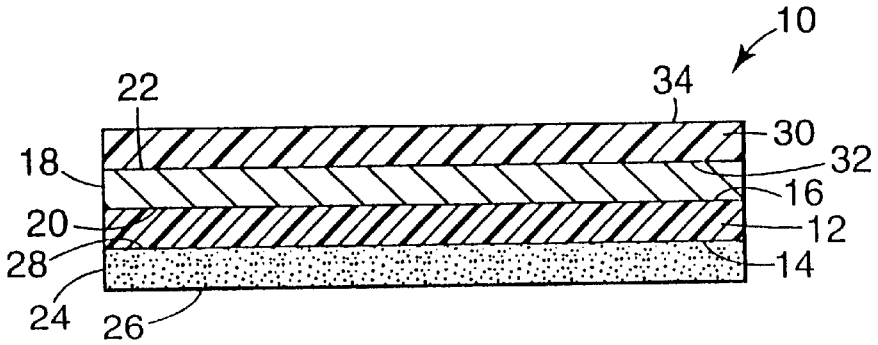
FIG. 1 is a cross section of a preferred embodiment of an imageable article of the present invention in tape form.

FIG. 1 is a cross section of a first preferred embodiment of the imageable article 10 of the present invention. Article 10 includes a substrate 12 having an imageable layer 18 thereon. As will be described in greater detail below, the imageable layer 18 comprises a metal/metal oxide layer that is imageable by a laser beam to impart a color to the imaged article 10. The substrate 12 includes first major surface 14 and second major surface 16 opposite the first major surface. The imageable layer 18 includes a first major surface 20 adjacent the second major surface 16 of the substrate 12. Imageable layer 18 also includes second major surface 22 opposite the substrate. The imageable article 10 preferably includes an adhesive layer 24 for applying the article 10 to any desired surface. This optional adhesive layer 24 includes an exposed first surface 26 and a second surface 28 which is in contact with the substrate 12. Typically, the image will be visible from the direction of the second major surface 22 of the imageable layer 18. Depending on the material of the substrate 12, it may be possible to see a version of the image through the substrate.

The article of FIG. 1 can be conveniently provided in roll form such as a tape. For such a form, it is desirable to add a low adhesion backsize layer 30 to the exposed surface of the imageable layer 18. This low adhesion backsize layer 30 includes a first surface 32 adjacent the imageable layer 18. When the article of FIG. 1 is provided in roll form, the first major surface 26 of the adhesive layer will be in contact with the second major surface 34 of the low adhesion backsize layer 30. Release coating compositions for the low adhesion backsize layer may include silicone, alkyl, or fluorochemical constituents, or combinations as the release imparting component. Useful release coating compositions for the invention include silicone containing polymers, such as silicone polyurethanes, silicone polyureas and silicone polyurethane/ureas, such as those described in U.S. Pat. Nos. 5,214,119, 5,290,615, 5,750,630, and 5,356,706, and silicone acrylate grafted copolymers described in U.S. Pat. Nos. 5,032,460, 5,202,190, and 4,728,571. Other useful release coating compositions include fluorochemical containing polymers such as those described in U.S. Pat. No. 3,318,852, and polymers containing long alkyl side chains such as polyvinyl N-alkyl carbamates (e.g., polyvinyl N-octadecyl carbamates) as described in U.S. Pat. No. 2,532,011, and copolymers containing higher alkyl acrylates (e.g., octadecyl acrylate or behenyl acrylate), such as those described in U.S. Pat. No. 2,607,711, or alkyl methacrylates (e.g., stearyl methacrylate) such as those described in U.S. Pat. Nos. 3,502,497 and 4,241,198, where the alkyl side chain includes from about 16 to 22 carbon atoms. These release polymers can be blended with each other and with thermosetting resins or thermoplastic film forming polymers to form the release coating composition. In addition, other additives may be used in the release coating compositions such as fillers, pigments, wetting agents, viscosity modifiers, stabilizers, anti-oxidants, and crosslinking agents.

Substantially any metal capable of forming an oxide or sulfide can be used in the practice of this invention for the imageable metal/metal oxide layer. In particular aluminum, tantalum, niobium, tin, chromium, nickel, titanium, cobalt, zinc, iron, lead, manganese, copper and mixtures thereof can be used. Most preferred is aluminum. Not all of these metals when converted to metal oxides will form materials having all of the specifically desirable properties (e.g., optical density, light transmissivity, absorptivity, etc.). However, all of these metal oxide containing layers will be useful and contain many of the benefits of the present invention including bondability to polymeric materials. The metal vapors in the chamber may be supplied by any of the various known techniques suitable for the particular metals e.g., electron beam heating evaporation, resistance heating evaporation, sputtering, etc. Reference is made to *Vacuum Deposition of Thin Films,* L. Holland, 1970, Chapman and Hall, London, England with regard to the many available means of providing metal vapors and vapor coating techniques, in general.

The metal/metal oxide imageable layer 18 has dispersed phases of materials therein; one is predominantly metallic and the other consists of at least one metal oxide. The latter material(s) are often transparent or translucent, while the former is opaque. The amount of particulate metal dispersed in the transparent oxide phase will affect the initial, non-imaged optical properties of the imageable layer 18. Imageable layers of yellowish, tan, gray, blue, purple, magenta, brown, gold, copper and black may be provided from a single metal by varying the percentage of conversion of the metal to oxide during deposition of the coating layer.

The metal/metal oxide layer is preferably from about 25 to 500 nanometers thick. In some applications it is preferred that the percent of oxygen atoms be substantially constant throughout the thickness of the imageable layer, i.e., the percent of the oxygen atoms relative to the total number of atoms of the metal and oxygen varies by less than 10 percentage points from one surface to the other. In other applications, it is preferable to have a gradient in the percent of the oxygen atoms. Preferably, the percent of oxygen atoms varies by more than 10 percentage points from one surface to the next, more preferably at least 40 percentage points. More preferably, the imageable layer approaches pure metal on one side, and approaches a stoichiometric oxide on the opposite side. As a practical matter, for an aluminum/aluminum oxide imageable layer, the highest gradient achievable is a difference in percent of oxygen atoms of approximately 60 percentage points. For an aluminum/aluminum oxide imageable layer, one preferred embodiment has approximately 20 percent oxygen atoms on one surface, and approximately 60 percent oxygen atoms on the opposite surface.

Methods and apparatus for forming the metal/metal oxide onto the substrate are well known to those of skill in the art. Suitable methods are disclosed in U.S. Pat. No. 4,430,366, Metal/Metal Oxide Coating, Crawford, et al.; and in U.S. Pat. No. 5,766,827, Process of Imaging Black Metal Thermally Imageable Transparency Elements, Bills et al. Particularly preferred methods and apparatus are described with regard to the examples below.

The substrate 12 of the present invention may comprise any materials which are presently known to be acceptable for the vapor deposition of metals, which includes substantially any material. Substrates may comprise metals, glasses, ceramics, organic polymers, inorganic polymers, thermoplastic resins, thermosetting resins, paper, fibrous materials shaped articles, films, sheets, etc. In particular, polymeric substrates of thermoplastic or thermosetting resins are preferred. Among the most useful resins are polyesters, polyacrylates, polycarbonates, polyolefins, polyamides, polysiloxanes, polyepoxides, etc. Particularly preferred substrates are polyesters. The substrates may be primed to promote adhesion or modified according to the various techniques known to provide different properties and characteristics to materials as may be desired in any specific instances, including dispersion of magnetizable, magnetic, metallic, or semiconductive particles, materials adding optical or electrical properties, flexibilizers, electrostatic reducing materials, antioxidants, etc.

Each surface of the substrate 12 may be treated (e.g., primed, etc.) according to various techniques known in the art to provide different properties and characteristics (e.g., adhesion promotion, release, etc.) to surfaces of materials as may be desired for use in any particular application. For example, it may be desirable to include a surface treatment between the substrate 12 and the imageable layer 18 to promote the strength of the attachment of the imageable layer to the substrate. Such a treatment may also help prevent portions of the metal/metal oxide layer from being discharged from the substrate during imaging. Suitable surface treatments include applying a low surface energy composition, priming, corona discharge, flame treatment, roughing, etching, and combinations thereof. Suitable materials for increasing the bond between the substrate and the metal/metal oxide layer include titanium and silane coupling agents.

Adhesive layer 24 may be any desired adhesive which serves to bond the imageable article to a selected adherend. Various types of adhesives are suitable including, but not limited to, thermosetting adhesives such as epoxide resins, urea-formaldehyde resins, phenol-formaldehyde resins, unsaturated polyesters, crosslinked polyurethanes and phenolics; thermoplastic adhesives such as poly(vinyl acetate) and carboxylated styrene-butadiene; hot melt adhesives such as ethylene/vinyl acetate, polyamides and polyesters; and elastomeric adhesives such as acrylics, silicones, poly (isobutylenes), poly(butadienes), poly(alpha-olefins), natural and synthetic rubbers including styrenic block copolymers, and poly(vinyl ethers), all of which may also be formulated to be pressure sensitive adhesives if desired. Other adhesive materials suitable for use include polyurethanes, cyanoacrylates and anaerobic-curing materials. See "Handbook of Adhesives", 3rd Ed., I. Skeist (Ed.), pp. 5–9 and 21–38, Van Nostrand Reinhold, New York, N.Y., 1990.

Figure 2:
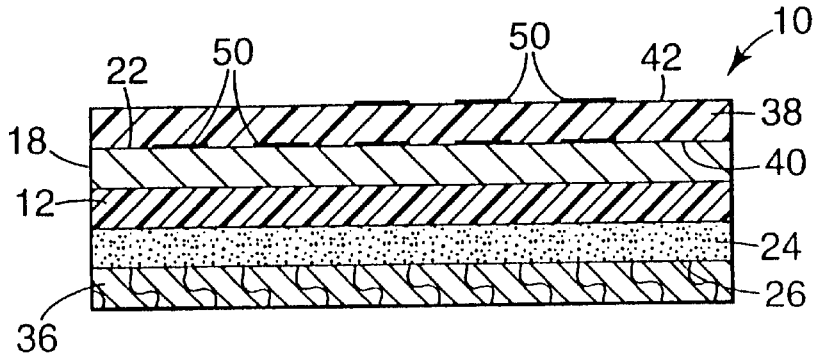
FIG. 2 is a cross section of a preferred embodiment of an imageable article of the present invention in label form with an optional release liner and optional protective coating.

FIG. 2 is a cross section of another preferred embodiment of the imageable article 10. This embodiment is particularly well suited for use as a label material. Substrate 12, imageable layer 18, and adhesive layer 24 are provided as described with respect to the other embodiments of the present invention. Additionally, a release liner 36 is temporarily applied to the exposed surface 26 of the adhesive layer 24. This release liner is then removed to allow the article 10 to be applied to any desired surface. Release liners are well known to those of skill in the art, and need not be described in any greater detail herein. Also illustrated in the embodiment of FIG. 2 is an optional protective layer 38. Protective layer 38 has a first major surface 40 in contact with the second major surface 22 of the imageable layer. Protective layer 38 also has an exposed surface 42 opposite the imageable layer. The protective layer 38 is provided to protect the imageable metal/metal oxide layer 18 from wear, scratching, and other environmental factors that might adversely affect the imageable layer 18. When it is intended that the imageable layer 18 be imaged by application of a laser beam through the protective layer 38, the protective layer should be chosen to allow laser imaging to occur. Suitable protective layers can be coated or extruded onto the article, and include those commercially available as SCOTCHGARD brand Film and Photo Protector from Minnesota Mining and Manufacturing Company, St. Paul, Minn.

Also shown in FIG. 2 is optional printed material 50. Print may be applied to the exposed surface 22 of the imageable metal/metal oxide 18 before applying the protective layer 38. Alternatively, printed material 50 may be applied to the second major surface 42 of the protective layer 38. The printed material can be added before or after laser imaging the article. Suitable print techniques include flexographic, electrophotographic, silk screen, and lithographic printing.

Figure 3:
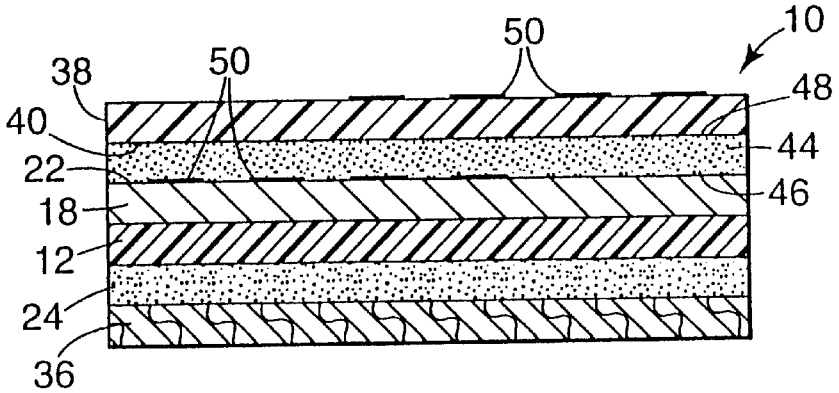
FIG. 3 is a cross section of a preferred embodiment of an imageable article of the present invention in an alternate label form with an optional release liner and alternate protective coating.

FIG. 3 illustrates another preferred embodiment of the imageable article 10, also suitable for a use as a label material. The substrate 12, imageable metal/metal oxide layer 18, primary adhesive layer 24, and release liner 36 are provided as described above. Additionally, a second adhesive layer 44 is applied to the second surface 22 of the imageable metal/metal oxide layer. This adhesive layer 44 bonds protective layer 38 to the imageable layer 18. This embodiment is particularly well suited for use with embodiments of protective layer 38 provided in film form. Suitable secondary adhesives 44 and protective layers 38 include those commercially available as 3M 7723 Overlaminating Film, a matte acetate film with a pressure sensitive adhesive layer, from Minnesota Mining and Manufacturing Company, St. Paul, Minn. As discussed above, printed material 50 may also be applied to the article 10 of FIG. 3. Printed material can be applied to the second surface 22 of the imageable layer prior to applying the protective layer and adhesive. Alternatively, printed material 50 can be applied to the exposed surface of the laminated protective layer 38. Print can also be applied to other surfaces on or within the article 10, including on the adhesive layer.

In any embodiment of the imageable article described herein, the protective layer 38, or a similar additional layer, can be shaped or contoured as desired. For example, there may be a convex contour on the exposed surface of the article. This may be achieved, for example, with a urethane protective layer 38.

Figure 4:
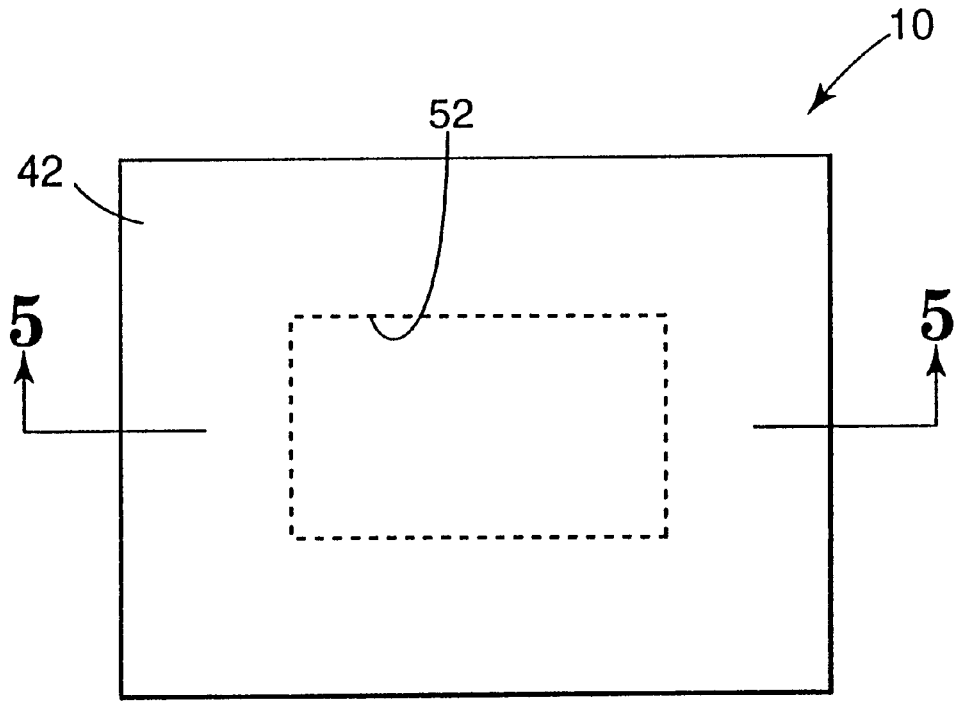
FIG. 4 is a plan view of a preferred embodiment of an imageable article of the present invention in the form of a label having an opening therein.
Figure 5:
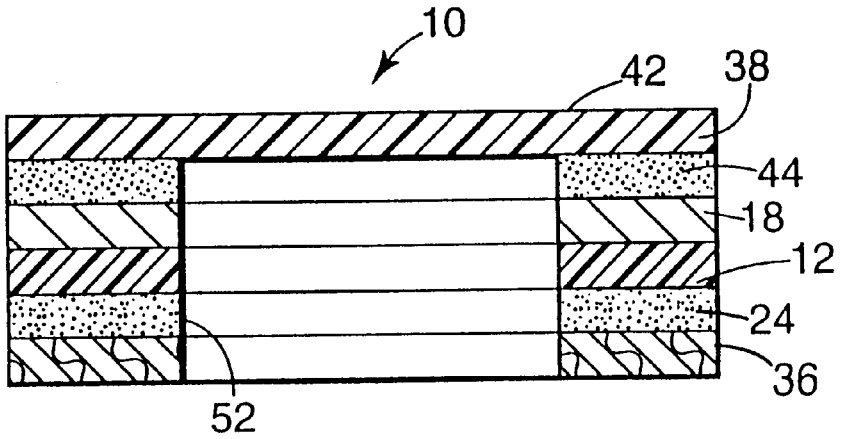
FIG. 5 is a cross section taken along line 5—5 of the article of FIG. 4.

Yet another preferred embodiment of imageable article 10 suitable for use as a label is illustrated in FIGS. 4 and 5. This embodiment is similar to the embodiment described above with respect to FIG. 3. However, this embodiment also includes a window 52. This window is formed such as by die cutting through all of the layers except for the top protective layer 38. Such an article is particularly useful for applications in which some portion of the item to which the imaged article is applied is to remain visible. For example, the imageable article 10 of FIGS. 4 and 5 could be applied over a digital or LCD display such as is present on items such as a pager or telephone. The window 52 allows the user to see the display or other material on the article. Around the periphery of the window, the imageable article may be imaged with laser as described herein.

The deliberate visible transformation of the deposited metal/metal oxide imageable layer 18 to colors is accomplished through heating via a laser of appropriate fluence. At the elevated temperature induced by the interaction of the laser beam with the imageable layer, the optical properties of the imageable layer are transformed in place, with no significant effect on the overall thickness of the imageable layer as measured by available analytical means. The change in optical properties can be achieved through changing the distribution of metal oxidation states within the metal/metal oxide imageable layer 18 and/or changing the size of particles of either or both of the phases. A precise understanding of the exact mechanism producing changes in the optical properties of the layer is not necessary to carry out the present invention. However, it is hypothesized that the mechanism may involve any or a combination of: disproportionation reactions; oxidation-reduction of complementary mixed phases; or physical changes in phase dimensions within the layer, such as breaking down larger particles of either or both of the phases in the metal/metal oxide layer. Under other conditions of irradiation, other mechanisms of chemical or physical change may occur, which also result in formation of a visible image.

The generation of color is thought to be the result of the interaction of visible light with the modified imageable layer 18 and a contrast layer underlying the transformed imageable layer. In the exemplified imageable articles having a gradient metal/metal oxide layer of the invention, the contrast layer is provided by the portion of the gradient metal/metal oxide layer which has a metallic appearance, i.e.; the surface having the higher metal and lower oxygen content. However, it is possible to produce a gradient layer of the appropriate imaging characteristics (varying metal to metal oxide ratio with depth) without producing a metallic reflector as part of the gradient oxide. A separate metallic reflective layer (same or different metal) may be added in a subsequent step.

This invention also includes embodiments wherein an optically effective contrast element different from the metal/metal oxide layer is present, preferably in direct contact with the metal/metal oxide layer. The contrast layers may include, but are to not limited to organic or inorganic binder materials with appropriate pigments or fillers to render them substantially white or reflective, binders incorporating engineered reflective elements such as glass bubbles, glass beads (with and without optical coatings) or other shapes, microreplicated reflective elements including surface-structured films, or microporous light diffusers. The invention also comprises color gradients other than those described in the examples, wherein the observed colors result from the interaction of light with the gradient oxide and contrasting base color or reflective properties of a separate layer attached directly to the gradient oxide.

A preferred method according to the present invention includes: providing an article including a substrate and an imageable layer, the imageable layer comprising a metal/metal oxide layer; imagewise applying a laser beam to the article; and, in the portion of the article having the laser applied thereto, imparting a color to the metal/metal oxide layer different from the color in the non-imaged portion. As used herein, the term "color" does not include simply rendering the imageable article transparent. It is preferred that the imparted color includes a shift in hue relative to the non-imaged portion of the imageable layer. The laser may be of any type known in the art that provides the laser beam in a manner described herein to impart a color to the imageable layer. Also, any commercially available computer-controlled driver may be used to provide the desired image or pattern to the imageable article. Suitable lasers include continuous or pulsed, single or multiphased diode lasers, Nd:YAG lasers, and rare earth fiber lasers. Suitable laser apparatus and drivers are also described with regard to the examples below.

Enough fluence must be imparted to provide sufficient change to the imageable layer to impart a color. However, it is preferred to avoid significant ablation of the imageable layer. When a protective layer is provided, ablation could interfere with the bond or integrity of the protective layer. Also, in many applications it will be desirable to avoid contamination that may occur if ablation of the imageable layer occurs. Preferably, the laser applies a fluence of no more than 3 $J/cm^2$, more preferably 500 $mJ/cm^2$, and still more preferably no more than 200 $mJ/cm^2$. It is also preferable that the laser beam is applied for between 30 nanoseconds and 30 milliseconds to each respective imaged portion.

The laser beam may be applied to the exposed surface 22 of the imageable layer when no protective layer is present. If desired, a protective layer may then be added. When the protective layer is present, the laser beam may be applied through the protective layer to the imageable layer. Alternatively, if the substrate 12 is selected to allow the laser beam to effectively pass though, then imaging may occur through the substrate.

In one preferred embodiment, the laser is applied so as to impart a visually perceptible color to the imageable layer. Visually perceptible is used herein to mean visually perceptible to the unaided eye. In another preferred embodiment, the laser is applied to impart at least two different visually perceptible colors. This may be done by applying at least two different values of fluence in two different imaged portions.

It may also be preferred to impart a color sufficiently distinct from the non-imaged portion so as to impart a machine-readable image, such as in the image of a bar code that is readable by the desired machine-vision apparatus.

The operation of the present invention will be further described with regard to the following detailed examples. These examples are offered to further illustrate the various specific and preferred embodiments and techniques. It should be understood, however, that many variations and modifications may be made while remaining within the scope of the present invention.

EXAMPLE 1

A polymeric film substrate 12 having a gradient coating of aluminum/aluminum oxide imageable layer 18 was prepared. More specifically, a 0.18 mm (0.007 inch) thick, biaxially oriented, transparent poly(ethylene terephthalate) (i.e., polyester) (PET) substrate was provided with an aluminum/aluminum oxide gradient imageable layer using a vacuum deposition coating apparatus.

The vacuum deposition coating apparatus had two adjoining chambers. In the first chamber, a primer layer of titanium was sputter-coated, in an argon atmosphere, onto the surface of the 129.5 cm (51 inch) wide polyester film substrate to be vapor coated. In the second chamber was a set of electrically heated resistance bars, located 30.5 cm (12 inches) below the moving polyester film substrate. The heated bars were positioned with their lengths parallel to the direction of the moving substrate and spaced to provide uniform coverage across the substrate by the overlapping aluminum vapor plumes. In addition, a pair of moveable baffles was located 15.2 cm (6 inches) below the substrate and 6 inches above the resistance heated bars to control the rate at which the aluminum vapor approached the substrate. The baffles were positioned perpendicular (and in a parallel plane) to the moving substrate and had a length exceeding the width of the substrate. An oxygen bleeder tube was positioned parallel to the up-web edge of the down-web baffle and in contact with it. The length of the oxygen bleeder tube exceeded the width of the substrate and contained holes 0.79 mm (0.031 inches) in diameter spaced 1.3 cm (0.5 inches) apart. The holes were located along the side of the bleeder tube in a plane parallel to that of the moving substrate and faced the up-web direction.

The above described vacuum deposition apparatus was evacuated down to a pressure of $2.5\times10^{-3}$ Torr and the electrically heated resistance bars were heated to a temperature sufficient to vaporize aluminum. The polyester substrate was then fed through the apparatus at a speed of 39.6 meters/minute (mpm) (130 feet per minute (fpm)) and lightly primed with titanium, to give a thickness of several Angstroms in the first chamber, then exposed to aluminum metal vapor in the second chamber. Aluminum wire having a diameter of 1.57 mm (0.062 inches) and a purity of 99.0% was fed onto the electrically heated resistance bars to provide for deposition of an aluminum metal vapor layer onto the primed surface of the polyester film substrate. The baffles were adjusted until the deposited aluminum exhibited an electrical conductivity of 2 Mhos as measured by an on-line inductively coupled conductance monitor.

Next, the web speed of the polyester substrate was decreased to 33.5 mpm (110 fpm) and oxygen was fed into the bleeder tube at a rate of 1.5 standard liters per minute (slpm) which caused the pressure in the apparatus to increase to $2.8\times10^{-3}$ Torr. A vapor coating was obtained which was shiny silver in appearance viewed through the backside, i.e., through the polyester substrate, and was dark blue-black colored in appearance when viewed from the frontside i.e., oxide deposited side. An article having a substrate and an imageable layer of aluminum/aluminum oxide was thus obtained.

The article having a substrate and an imageable layer was characterized using the following means. Auger Electron Microscopy was used to determine the percent of oxygen atoms of the imageable layer at the PET interface and the outer surface. The results were 8% and 58% respectively. Analysis by Transmission Electron Microscopy (TEM) revealed a deposit thickness of approximately 180 nanometers (nm). The imageable layer was further characterized by the following tests. The optical density was measured using a Macbeth Model TD-931 Densitometer (available from GretagMacbeth™ LLC, New Windsor, N.Y.). The electrical conductivity was measured using a Model 707B Conductance Monitor (available from Delcom Instruments, Inc., St. Paul, Minn.). Reflectance, transmission, and (by difference) absorbance were determined for both the shiny silver side (through the polyester film) and the dark oxide side, and were measured at a wavelength of 810 nanometers using a Lambda 900 spectrophotometer (available from Perkin Elmer Corporation, Norwalk, Conn.). The results are shown in Table 1.

EXAMPLES 2–9

Example 1 was repeated with modifications to the substrate, web speed and oxygen flow. These are shown in Table 1 along with test results.

TABLE 1

| Ex. | Substrate (thickness, mm) | Web Speed (mpm) | Oxygen Flow (slpm) | Color | Optical Density | Conduct. (Mhos) | % Reflect. | % Transm. | % Absorb. |
|---|---|---|---|---|---|---|---|---|---|
| 1 | T-PET (0.18) | 33.5 | 1.5 | Dark Blue-Black | 4.20 | 0.435 | P: 83 * O: 18 * | P: 0 * O: 0 * | P: 17 * O: 82 * |
| 2 | T-PET (0.05) | 39.6 | 2.0 | Dark Rose | 4.25 | 0.625 | 28 | 0 | 72 |
| 3 | T-PET (0.05) | 39.6 | 3.0 | Green-Black | 3.55 | 0.318 | 8 | 0 | 92 |
| 4 | T-PET (0.05) | 39.6 | 4.0 | Purple-Black | 3.31 | 0.337 | 10 | 0 | 90 |
| 5 | T-PET (0.05) | 39.6 | 9.0 | Black | 1.50 | 0.046 | 7 | 6 | 87 |
| 6 | W-PET (0.05) | 39.6 | 9.0 | Black | 1.90 | 0.025 | 6 | 3 | 91 |
| 7 | W-PET (0.05) | 79.2 | 3.0 | Light Gold | 2.90 | 0.342 | 68 | 0 | 32 |

TABLE 1-continued

| Ex. | Substrate (thickness, mm) | Web Speed (mpm) | Oxygen Flow (slpm) | Color | Optical Density | Conduct. (Mhos) | % Reflect. | % Transm. | % Absorb. |
|---|---|---|---|---|---|---|---|---|---|
| 8 | W-PET (0.05) | 79.2 | 4.0 | Gold | 2.30 | 0.179 | 62 | 0 | 38 |
| 9 | W-PET (0.05) | 79.2 | 6.0 | Copper | 2.10 | 0.125 | 49 | 1 | 50 |

T-PET = transparent PET;
W-PET = $TiO_2$ filled, white colored PET.
* For Example 1, P = measured from the PET side, O = measured from the oxide side; for Examples 2–9 measurements were made from the oxide side only.

EXAMPLE 10

A pulsed laser beam was applied to imageable article of Example 5 to provide images which were used to determine the effective dimensions of the laser beam. The laser beam was applied to the exposed metal/metal oxide surface using an apparatus having a 1.3 Watt multimode, pulsed, single diode laser, a collimating tube, a laser driver and a software driver. The diode laser (Model SDL-23-S9850, available from SDL Inc., San Jose, Calif.), which operated at 809 nanometers, was mounted in a Laser Package Focusing Tube with Optics (Model LT230260P-B, available from ThorLabs, Newton, N.J.).

The laser beam was driven at a power level just above that required for lasing and was coarsely focused by adjusting the position of the collimation lens to minimize the beam dimensions as measured using an infrared sensor (Model Q-32-R, available from Quantex Inc., Rockville, Md.). The laser diode and Laser Package Focusing Tube with Optics was placed in a modified pen holder attached to a Graftec Model FG 2200-30 Cutting Pro plotter/cutter (available from Western Graftec, Inc., Irvine, Calif.) which had a maximum sweep rate of 30 centimeters/second (cm/sec) (11.8 inches/second).

The laser beam was then driven at a power level of 1000 mW and the position of Laser Package Focusing Tube with Optics having the laser diode in it was adjusted within the modified pen holder to give the smallest spot size.

The laser diode was powered by a Newport Model 5060 Laser Driver (available from Newport Corporation, Irvine, Calif.). The laser driver was controlled by a software driver which was constructed using LABVIEW brand program (available from National Instruments, Corporation, Austin, Tex.).

The output power was set at 1.3 Watts and a 3 microsecond ($\mu$sec) pulse was applied every 900 $\mu$sec at a sweep rate=6 cm/sec. (2.4 inches/sec.). The resulting images in the laser treated areas were gold colored and measured 8×234 micrometers ($\mu$m) (0.0003×0.009 inches). The calculated fluence in these areas was 208 milliJoules/centimeter$^2$ (mJ/cm$^2$).

EXAMPLE 11

A pulsed laser beam from a high powered Neodymium Yttrium-Aluminum-Garnet (Nd:YAG) laser was applied to the imageable article of Example 1 to provide colored images. More specifically, imaging was carried out on the exposed metal/metal oxide surface using an 80 Watt laser available from General Scanning, Watertown, Mass. When the laser beam was focused to provide a 0.13 mm (0.005 inches) spot and pulsed (once) for 24 $\mu$sec at 1% of full power to treat the exposed metal/metal oxide surface, ablation was observed. Upon defocusing the laser by raising it 6.35 mm (0.25 inches) and again providing a single pulse on a new area of the metal/metal oxide surface, ablation was again observed. Next, the laser was raised another 15.2 mm (0.6 inches) and the process repeated on a new area of the metal/metal oxide surface. This time no ablation or visual color change was seen. The output power was increased to 10% (of full) and the process repeated on a new area of the metal/metal oxide surface, again with no ablation or observable color change. Finally, the laser was lowered 8.9 mm (0.35 inches), resulting in a distance of 12.7 mm (0.5 inches) above the original focus distance, and a new area of the metal/metal oxide surface was treated with a single pulse at 10% of full power. A purple-colored spot was seen in the laser treated area without any observable ablation.

EXAMPLE 12 AND COMPARATIVE EXAMPLE 1

A laser beam, in a continuous wave mode was applied to the imageable article of Example 1 on the exposed metal/metal oxide side, at input power levels between 1200 and 345 mW in 45 mW increments using the apparatus described in Example 10 with the following modifications. A test pattern having 20 rectangular boxes arranged in 4 rows was employed. The first 3 rows had 4 boxes each. In the first row the boxes had a width of between 18 and 25 millimeters (mm) and a length of about 22 mm; the boxes in the second row bad a width of between 18 and 25 millimeters (mm) and a length of about 28 mm; the boxes in the third row had a width of between 18 and 25 millimeters (mm) and a length of about 32 mm; the fourth row had 8 boxes, 4 boxes having a width of 10 mm and a length of between 10 and 22 mm, 2 boxes having a width of 23 mm and a length of between 12 and 14 mm, and 2 boxes having a width of between 16 and 22 mm and a length of 29 mm.

The boxes were created as grayscale images using ADOBE brand PHOTOSHOP brand software (available from Adobe Systems, Inc., San Jose, Calif.) and saved as "*.bmp" graphic image computer files. LABVIEW brand software was used to convert the graphic image files into a raster output signal using lookup tables.

These were imaged with raster lines 0.10 mm (0.004 inches) on center at a sweep rate of 30 cm/sec (11.8 inches/sec). The laser input power was adjusted between boxes within 0.5 milliseconds (msec) of receiving a command from the software driver (hereinafter referred to as "response time").

The imaged article was evaluated visually for color change. The imaged article was also evaluated by Transmission Electron Microscopy (TEM) for changes in thickness of the vapor coated layer which would be evidence of ablation. Results for selected boxes representing visually perceptible color changes are reported in Table 2. Note that at 345 mW, no visually perceptible color change was imparted, thus demonstrating a comparative example.

For examples 12a, c, and d, thickness of the imageable layer was measured to be 180 nanometers before imaging. For these Examples, the thickness was measured in the imaged portion after imaging. For substantially the entire imaged area, thickness after imaging was the same as for the non-imaged portion, indicating that substantially no ablation occurred in the imaged area.

EXAMPLE 13

A laser beam was applied to the imageable article of Example 2 on the exposed metal/metal oxide side at various power levels and evaluated as described in Example 12 with the following modifications. The power input range was varied between 1000 and 650 mW in 70 mW increments. A test pattern having 6 rectangular boxes arranged in 2 rows of 3 was employed. The boxes in the first row had a width of about 40 mm and a length of about 37 mm; the boxes in the second row had a width and length about 40 mm. Results for selected boxes representing visually perceptible color changes are reported in Table 2.

EXAMPLE 14

An article having an imaged area beneath a protective polymeric film layer was provided by imaging through the protective layer. More specifically, Example 13 was repeated after first applying a transparent protective film 38 of 0.05 mm (0.002 inch) thick PET having a pressure sensitive adhesive 44 on one side to the exposed metal/metal oxide surface 22 using a nip roll laminator at room temperature such that the pressure sensitive adhesive contacted the exposed metal/metal oxide surface. The adhesive was prepared in accordance with Example 6 of U.S. Pat. No. Re. 24,906, Pressure Sensitive Adhesive Material (Ulrich). The resulting construction was imaged through the protective film as described in Example 13, with the following modifications, to impart a color to the imageable layer beneath the protective film. The power input range was varied between 1300 and 850 mW in increments of 90 mW, the sweep rate was 25 cm/sec (9.8 inches/sec) and the response time was about 0.6 msec. There was no visual evidence of outgassing after imaging, eg., no bubbling between the protective film and metal/metal oxide layer was observed. Results for selected boxes representing visually perceptible color changes are reported in Table 2.

TABLE 2

| Ex. | Input Power Level (mW) | Color before imaging | Color of imaged portion |
|---|---|---|---|
| 12a | 1065 | Dark Blue-Black | Bright Gold |
| 12b | 885 | Dark Blue-Black | Bronze |
| 12c | 840 | Dark Blue-Black | Rose |
| 12d | 615 | Dark Blue-Black | Dark Blue |
| 12e | 480 | Dark Blue-Black | Dark Blue |
| CE 1 | 345 | Dark Blue-Black | Dark Blue-Black |
| 13a | 1000 | Rose-Black | Bright Gold |
| 13b | 860 | Rose-Black | Bronze |
| 13c | 720 | Rose-Black | Rose |
| 13d | 650 | Rose-Black | Purple |
| 14a | 1300 | Rose-Black | Bright Gold |
| 14b | 1120 | Rose-Black | Bronze |
| 14c | 940 | Rose-Black | Rose |
| 14d | 850 | Rose-Black | Purple |

EXAMPLE 15

A label article having an imaged layer beneath a protective polymeric film layer was provided by imaging through the protective layer. More specifically, the imageable article of Example 1 was laminated with 3M 9185 Laminating Adhesive (available from Minnesota Mining and Manufacturing Company, St. Paul, Minn.) by removing the silicone-coated paper release liner and applying the exposed adhesive layer 44 to the metal/metal oxide surface 22 using a nip roll laminator at room temperature such that the remaining protective clear plastic liner faced outward. The clear protective liner was then removed and a sheet of 0.51 mm (0.020 inch) thick polycarbonate film 38 (available as LEXAN from GE Plastics, a division of GE General Electric Corporation, Pittsfield, Mass.) was laminated to the exposed adhesive layer 48, again using the nip roll laminator. To the exposed PET surface 14 on the opposite side was applied 3M No. 468 Linered Adhesive (available from Minnesota Mining and Manufacturing Company, St. Paul, Minn.) to provide a label construction having an adhesive layer 24 and release liner 36. This construction as then imaged through the polycarbonate protective layer 38 and adhesive layer 44 as described in Example 12, with the following modifications. The input power setting was 1200 mW and the sweep rate was 15 cm/sec (5.9 inches/sec). This imparted a sharp, two-colored image of gold and magenta beneath the protective film and adhesive layer in the laser treated area. Upon visual inspection, no evidence of outgassing or ablation was observed.

EXAMPLE 16

A cut-out article having an open window area and a imaged border beneath a protective polymeric film layer generally as illustrated in FIGS. 4 and 5 was prepared by imaging through the protective film layer 38. More specifically, the imageable article of Example 1 was provided with 3M 9185PT Laminating Adhesive (available from Minnesota Mining and Manufacturing Company, St. Paul, Minn.) by first removing the silicone-coated paper release liner and applying the exposed adhesive to the dark blue-black colored metal/metal oxide surface using a nip roll laminator at room temperature such that the protective clear plastic liner faced outward.

The resulting laminate of PET 12/(metal/metal oxide) 18/adhesive 44/protective clear liner was placed on a flat table with the protective liner side down. Four separate openings 52, each measuring about 1.27×3.18 cm (0.5×1.25 inches) and separated by about 5.08 cm (2 inches), were stamped out with a machined die. The clear protective liner was then removed and a sheet of 0.51 mm (0.020 inches) thick LEXAN polycarbonate film 38 was laminated to the exposed adhesive layer 48 by hand using a rubber roller.

The resulting construction was imaged through the protective polycarbonate film and adhesive to provide gold and magenta colored text and graphic images on a dark blue-black colored background around the cutout areas using the apparatus described in Example 12 with the following modifications. The input power level was varied between 1200 and 300 mW, the sweep was 15 cm/sec. (5.9 inches/sec.), and the response time was about 1.1 msec.

EXAMPLE 17

An article having an image of a bar code beneath a protective polymeric film layer 38 was provided by imaging through the protective film layer. More specifically, 3M 7723FL Overlaminate Film (available from Minnesota Mining and Manufacturing Company, St. Paul, Minn.) was applied at room temperature to the imageable article of Example 1 using nip rollers such that the pressure sensitive adhesive layer 44 of the overlaminate film 38 was bonded to the exposed metal/metal oxide surface 22. The resulting construction was imaged through the protective film layer and adhesive as described in Example 12 with following modifications. The input power was 1200 mW, the sweep rate was 12 cm/sec (4.7 inches/sec), and the response time was 1.3 msec. A gold colored bar code image (Code 3 of 9 bar code symbology) mils was produced in the laser treated area beneath the protective film layer. This bar code image was scanned using a Symbol MSI LaserchekII diagnostic equipment, with a 680 mn wavelength laser scanner Model LCS-2911-000A, and a portable data printer, Model LCT2911 (from Symbol Technologies, Costa Mesa, Calif.), and gave a Grade B reading according to ANSI Standard (American National Standards Institute). There was no visual evidence of outgassing or bubbling (i.e. no delamination of the protective film from the imaged area).

EXAMPLE 18

A construction having a rasterized image combined with a separately positioned bar code, all under a protective polymeric film layer was provided by imaging through the protective layer. More specifically, 3M 7745 Overlaminate Film (available from Minnesota Mining and Manufacturing Company, St. Paul, Minn.) was applied at room temperature to the imageable article of Example 1 using nip rollers at room temperature such that the pressure sensitive adhesive 44 of the protective film layer 38 bonded to the exposed metal/metal oxide surface 22. The resulting construction was imaged through the protective film layer as described in Ex. 12 with following modifications. The input power was varied from 450 to 1600 mW, and the raster lines were 0.13 mm (0.005 inches) on center.

Several graphic images and text, including an area having a uniform gradient of 0 to 100% grayscale, were combined using ADOBE PHOTOSHOP software and saved in grayscale mode as a "*.bmp" file. This file was converted into a raster output signal using lookup tables and LABVIEW software, which was also used to provide both bar code patterns and their position as an overlay on top of the graphic images and text. These bar code images could be positioned anywhere over the graphics and/or text. The resulting images produced in the laser treated area beneath the protective film layer had multiple colors ranging from gold to dark blue as described in Example 12. There was no visual evidence of outgassing or bubbling (i.e. no delamination of the protective film from the imaged area).

EXAMPLE 19

Example 18 was repeated with the following modifications. SCOTCHGARD brand Photo Protector Matte (available from Minnesota Mining and Manufacturing Company, St. Paul, Minn.) was applied at room temperature to the exposed metal/metal oxide surface 22 of the imageable article of Example 1 using a Number 4 Meyer rod. This was cured with high pressure mercury lamps per manufacturer's specifications to provide a hard protective overcoat layer 38 with a matte surface. The resulting construction was imaged through the hard protective overcoat layer as described in Example 18 with following modifications. The input power was varied from 450 to 1250 mW. The resulting images produced in the laser treated area beneath the protective overcoat layer had multiple colors ranging from gold to dark blue as described in Example 12. The transparent protective coating 38 remained intact over both the laser treated and untreated areas as determined by visual inspection.

EXAMPLE 20

Example 2 was repeated with the following modifications. In the first oxygen tube, every other hole was blocked to obtain 2.5 cm (1 inch) spacing of the holes. A second oxygen bleeder tube having holes the same diameter as the first was positioned parallel to the down-web edge of the up-web baffle and in contact with it. The holes in the second tube were 2.5 cm apart (1 inch) and were located along the side of the bleeder tube in a plane parallel to that of the moving web and faced the down-web direction. Web speed was 35.0 meters/min (115 feet/min). Oxygen flow was 4.0 slpm.

A vapor coating was obtained which was brown-black when viewed through the backside, i.e., through the 0.05 mm (0.002 inch) thick transparent polyester film substrate, and dark bronze when viewed from the frontside i.e., oxide deposited side. An article having a substrate and an imageable layer of aluminum/aluminum oxide was thus obtained. The metal/metal oxide coating was substantially uniform with respect to the percent of oxygen atoms, approximately 56% oxygen atoms on each side as measured by Auger Electron Microscopy. The resulting article having a substrate and an imageable layer was evaluated for optical density, conductance, reflectance, transmission and absorbance as described in Example 1. The results were as follows: optical density was 1.03; conductivity was 0.007 Mhos; reflectivity was 28% on the substrate side, 16% on the metal/metal oxide side; transmission was 16% on both the substrate side and metal/metal oxide side; and absorbance was 56% on the substrate side, 68% on the metal/metal oxide side.

COMPARATIVE EXAMPLE 2

The imageable article of Example 20 was imaged as described in Example 12 with the following modifications and with a different image pattern. A piece of white paper was placed on the plotter surface followed by placement of the imageable article of Example 20 onto the paper such that the exposed surface of the metal/metal oxide coating contacted the paper. The laser beam was applied through the PET substrate to the metal/metal oxide coating at an input power level of 1400 mW and a sweep rate of 18 cm/sec (7.09 inches/sec).

The imaged sample was evaluated visually for color change and ablation. A black residue was observed on the white paper beneath the imaged article and was taken as evidence of ablation. The results are shown in Table 3 below.

EXAMPLE 21

Comparative Example 2 was repeated with the following modifications. A 100% solids liquid composition of 65 parts by weight (pbw) of XB 4122 Epoxy Resin (a flexible aromatic epoxide resin available from Ciba-Geigy, Ardsley, N.Y.), 35 pbw ERL 4221 (a cycloaliphatic epoxide resin available from Union Carbide Chemicals and Plastics Incorporated, Danbury, Conn.), and 1 pbw of triphenylsulfonium hexafluoroantimonate photocatalyst was knife-coated over the exposed metal/metal oxide surface to give a 0.05 mm (0.002 inches) thick coating before photocuring. This was cured at 350 nm for 20 minutes using a black light source. The resulting imageable article had a cured epoxy coating which was flexible and clear.

This imageable article was imaged as described in Comparative Example 2 with the following modification. An input power of 1600 mW was employed. The imaged article was evaluated visually for color change and ablation. There was no black residue observed on the white paper beneath the imaged article indicating that no substantial ablation occurred, and a visually perceptible color was imparted to the laser treated areas of the imaged article. The results are shown in Table 3 below.

EXAMPLES 22–25

Example 21 was repeated with the modification and results shown in Table 3 below. For Examples 23–25, a rainbow of colors was visible in the imaged portions when bright light at an angle of about 30° or less with respect to the plane of the surface.

EXAMPLES 26–27

Example 21 was repeated, except without the white paper present, and with the modification and results shown in Table 3 below. For Example 27, a bright rainbow of colors visible in the imaged portions when viewed in bright light at an angle of about 60° or more with respect to the plane of the imaged surface.

For Examples 26 and 27, thickness of the imageable layer was measured to be 144 nanometers before imaging. For these Examples, the thickness was measured in the imaged portion after imaging. For substantially the entire imaged area, thickness after imaging was the same as for the non-imaged portion, indicating that substantially no occurred in the imaged area.

TABLE 3

| Ex. | Input Power Level (mW) | Color before imaging (viewed through substrate) | Color of imaged portions (viewed through substrate) |
|---|---|---|---|
| CE2 | 1400 | Brown-Black | Translucent |
| 21 | 1600 | Brown-Black | Gold-Brown |
| 22 | 1400 | Brown-Black | Gold-Brown |
| 23 | 1200 | Brown-Black | Rainbow Colors on Gold-Brown |
| 24 | 1000 | Brown-Black | Rainbow Colors on Gold-Brown |
| 25 | 800 | Brown-Black | Light Rainbow Colors on Brown |
| 26 | 1600 | Brown-Black | Gold-Brown |
| 27 | 1200 | Brown-Black | Bright Rainbow Colors on Gold-Brown |

The tests and test results described above are intended solely to be illustrative, rather than predictive, and variations in the testing procedure can be expected to yield different results.

The present invention has now been described with reference to several embodiments thereof. The foregoing detailed description and examples have been given for clarity of understanding only. No unnecessary limitations are to be understood therefrom. All patents and patent applications cited herein are hereby incorporated by reference. It will be apparent to those skilled in the art that many changes can be made in the embodiments described without departing from the scope of the invention. For example, security features or tamper indicating features may be combined with the imageable article. Thus, the scope of the present invention should not be limited to the exact details and structures described herein, but rather by the structures described by the language of the claims, and the equivalents of those structures.

What is claimed is:

1. A method for imaging an article, comprising the steps of:

a) providing an article including a substrate and an imageable layer, the imageable layer comprising a metal/metal oxide layer;

b) imagewise applying a laser beam to the article; and c) in the portion of the article having the laser applied thereto, imparting a color to the metal/metal oxide layer different from the color in the non-imaged portion.

2. The method of claim 1, wherein step b) further includes changing the distribution of metal oxidation states within the metal/metal oxide layer.

3. The method of claim 2, wherein step b) further includes changing the distribution of metal oxidation states within the metal/metal oxide layer through oxidation.

4. The method of claim 2, wherein step b) further includes changing the distribution of metal oxidation states within the metal/metal oxide layer through reduction.

5. The method of claim 2, wherein step b) further includes changing the distribution of metal oxidation states within the metal/metal oxide layer through disproportionation.

6. The method of claim 1, wherein step b) includes changing the size distribution of at least one of the phases of the metal/metal oxide layer.

7. The method of claim 1, wherein the imageable layer comprises an aluminum/aluminum oxide layer.

8. The method of claim 7, wherein step b) further includes changing the distribution of aluminum oxidation states within the aluminum/aluminum oxide layer.

9. The method claim 8, wherein step b) further includes changing the distribution of aluminum oxidation states within the aluminum/aluminum oxide layer through oxidation.

10. The method of claim 8, wherein step b) further includes changing the distribution of aluminum oxidation states within the aluminum/aluminum oxide layer through reduction.

11. The method of clam 7, wherein step b) includes changing the size distribution of at least one of the phases of the aluminum/aluminum oxide layer.

12. The method of claim 1, wherein the percent of oxygen atoms in the metal/metal oxide layer comprises a gradient, and wherein the percent of oxygen atoms varies from one surface to the opposite surface by at least 10 percentage points.

13. The method of claim 12, wherein the percent of oxygen atoms varies from one surface to the opposite surface by at least 40 percentage points.

14. The method of claim 1, wherein the imageable layer includes a reflective layer at one surface thereof.

15. The method of claim 1, wherein step b) comprises applying no more than 3 $J/cm^2$.

16. The method of claim 15, wherein step b) comprises applying no more than 500 $mJ/cm^2$.

17. The method of claim 16, wherein step b) comprises applying no more than 200 $mJ/cm^2$.

18. The method of claim 1, wherein step b) comprises applying the laser beam for between 30 nanoseconds and 30 milliseconds to each respective imaged portion.

19. The method of claim 1, wherein step c) includes imparting a visually perceptible color.

20. The method of claim 19, wherein step c) includes imparting at least two different visually perceptible colors.

21. The method of claim 1, wherein step c) includes imparting a color sufficiently distinct from the non-imaged portion so as to impart a machine-readable image.

22. The method of claim 21, wherein the machine readable image is in the form of a bar code.

23. The method of claim 1, wherein step c) includes imparting a color having a different hue than the non-imaged portion.

24. The method of claim 1, wherein step b) causes essentially no ablation in the imaged portion.

25. The method of claim 1, wherein the imageable article further includes a protective layer on the metal/metal oxide layer.

26. The method of claim 25, wherein the protective layer is laminated to the metal/metal oxide layer with a pressure sensitive adhesive.

27. The method of claim 1, wherein the imageable article includes an adhesive layer for attaching the imageable article to a surface.

28. The method of claim 27, wherein the imageable article includes a release liner temporarily attached to the adhesive layer.

29. The method of claim 27, wherein the imageable article includes a low adhesion backsize layer opposite the adhesive layer.

30. An imageable article imaged by the method of claim 1.

* * * * *

UNITED STATES PATENT AND TRADEMARK OFFICE

CERTIFICATE OF CORRECTION

PATENT NO. : 6,180,318 B1
DATED : January 30, 2001
INVENTOR(S) : Fitzer et al.

It is certified that error appears in the above-identified patent and that said Letters Patent is hereby corrected as shown below:

Column 17,
Line 8, after "when" insert -- viewed in --.
Line 15, after "colors" insert -- was --.
Line 23, after "no" insert -- ablation --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*